US009599109B2

(12) United States Patent
Yakushiji

(10) Patent No.: US 9,599,109 B2
(45) Date of Patent: Mar. 21, 2017

(54) INVERTER-INTEGRATED ELECTRIC COMPRESSOR AND ASSEMBLY METHOD THEREFOR

(75) Inventor: Shunsuke Yakushiji, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 535 days.

(21) Appl. No.: 12/956,528

(22) Filed: Nov. 30, 2010

(65) Prior Publication Data

US 2011/0193452 A1 Aug. 11, 2011

(30) Foreign Application Priority Data

Feb. 10, 2010 (JP) ..... 2010-027733

(51) Int. Cl.

| | |
|---|---|
| ***F04C 18/02*** | (2006.01) |
| ***F04C 29/04*** | (2006.01) |
| ***F04B 35/04*** | (2006.01) |
| ***F04B 39/06*** | (2006.01) |
| ***F04B 39/12*** | (2006.01) |

(52) U.S. Cl.

CPC ..... *F04C 18/0215* (2013.01); *F04B 39/06* (2013.01); *F04B 39/121* (2013.01); *F04C 29/047* (2013.01); *F04B 35/04* (2013.01); *F04C 18/0223* (2013.01); *Y10T 29/49002* (2015.01)

(58) Field of Classification Search

CPC ..... H01L 23/4012; H01L 2023/4037; H01L 2023/4062; H01L 2023/4068; F04C 18/0215; F04C 18/0223; F04C 15/0096; F04C 29/047; F04B 35/04; F04B 39/06; F04B 53/08

USPC ..... 417/410.1, 410.3–423.5, 423.8, 423.7; 310/43, 89, 71, 68 D; 361/767, 760, 704, 361/707, 719, 720

See application file for complete search history.

(56) References Cited

U.S. PATENT DOCUMENTS

| | | | | | |
|---|---|---|---|---|---|
| 4,103,321 | A | * | 7/1978 | Gansert et al. | 361/711 |
| 4,120,019 | A | * | 10/1978 | Arii et al. | 361/699 |
| 5,001,601 | A | * | 3/1991 | Fuoco | 361/699 |
| 5,473,510 | A | * | 12/1995 | Dozier, II | 361/719 |
| 5,590,026 | A | * | 12/1996 | Warren et al. | 361/704 |

(Continued)

FOREIGN PATENT DOCUMENTS

| | | | |
|---|---|---|---|
| EP | 1 909 377 | A1 | 4/2008 |
| JP | 9-283883 | A | 10/1997 |

(Continued)

OTHER PUBLICATIONS

JP2009156213A_MachineTranslationAbstract.*

(Continued)

*Primary Examiner* — Alexander Comley

(74) *Attorney, Agent, or Firm* — Westerman, Hattori, Daniels & Adrian, LLP

(57) ABSTRACT

An IGBT serving as a heat-generating electrical component mounted on the lower surface of a lower board serving as a control circuit board of an inverter is disposed in abutment with a heat-dissipating flat section provided on an inner wall of an inverter box provided on the outer periphery of a housing so that the heat of the IGBT is dissipated toward the housing. Moreover, a spacer member is interposed between the lower board and the IGBT so as to fill a space between the lower board and the IGBT, and the spacer member is rigid enough that the lower board and the IGBT are prevented from being displaced toward and away from each other.

6 Claims, 6 Drawing Sheets

(56) References Cited

U.S. PATENT DOCUMENTS

| | | | | |
|---|---|---|---|---|
| 6,195,257 | B1 * | 2/2001 | Janicek et al. | 361/704 |
| 6,342,766 | B1 * | 1/2002 | Cook et al. | 315/32 |
| 6,501,662 | B2 * | 12/2002 | Ikeda | 361/760 |
| 7,009,318 | B2 * | 3/2006 | Iritani et al. | 310/58 |
| 8,257,060 | B2 * | 9/2012 | Hattori et al. | 417/410.1 |
| 2002/0025265 | A1 * | 2/2002 | Ikeda | 417/410.1 |
| 2003/0143090 | A1 * | 7/2003 | Iritani et al. | 417/410.5 |
| 2004/0197213 | A1 * | 10/2004 | Takemoto | 417/410.1 |
| 2008/0266811 | A1 * | 10/2008 | Yamada et al. | 361/720 |
| 2008/0310131 | A1 * | 12/2008 | Fino et al. | 361/758 |
| 2009/0087322 | A1 * | 4/2009 | Toyama et al. | 417/410.1 |
| 2009/0104055 | A1 * | 4/2009 | Satou et al. | 417/410.1 |
| 2009/0162222 | A1 * | 6/2009 | Iguchi et al. | 417/410.1 |
| 2009/0246047 | A1 * | 10/2009 | Hattori et al. | 417/410.1 |

FOREIGN PATENT DOCUMENTS

| | | | | |
|---|---|---|---|---|
| JP | 2003-153552 | A | 5/2003 | |
| JP | 3786356 | B2 | 6/2006 | |
| JP | 2007-295639 | A | 11/2007 | |
| JP | 2007-306671 | A | 11/2007 | |
| JP | 2008-128142 | A | 6/2008 | |
| JP | 2009156213 | A * | 7/2009 | F04B 39/00 |

OTHER PUBLICATIONS

Japanese Office Action dated Jun. 4, 2013, issued in corresponding Japanese Patent Application No. 2010-027733, with English translation (6 pages).

Japanese Decision to Grant a Patent dated Jan. 14, 2014, issued in corresponding Japanese application No. 2010-027733 (3 pages). Explanation of Relevancy: The Decision to Grant a Patent has been received.

Search Report dated Oct. 25, 2016, issued in European Application No. 10192689.7 (8 pages).

* cited by examiner

INVERTER-INTEGRATED ELECTRIC COMPRESSOR AND ASSEMBLY METHOD THEREFOR

BACKGROUND OF THE INVENTION

1. Field of the Invention

The present invention relates to an inverter-integrated electric compressor particularly suitable for use in a vehicle air conditioner and formed by installing an inverter inside an inverter box provided on the outer periphery of a housing, and to an assembly method therefor.

This application is based on Japanese Patent Application No. 2010-027733, the content of which is incorporated herein by reference.

2. Description of Related Art

In recent years, in addition to vehicles that run using internal combustion engines, vehicles that run by utilizing electric power, such as electric vehicles, hybrid vehicles, and fuel-cell-powered vehicles, are rapidly being developed and made commercially available. In many air conditioners for such vehicles that utilize electric power, electric compressors having motors that operate with electric power as a driving source are used as compressors for compressing and supplying a refrigerant.

Similarly, in some air conditioners for vehicles that run using internal combustion engines, compressors that are driven by the internal combustion engines via electromagnetic clutches are replaced by electric compressors so as to solve the problem of reduced drivability caused by the intermittency of the electromagnetic clutches.

A common example of an electric compressor of this type is a sealed electric compressor in which a compression mechanism and a motor are integrally built inside a housing. Furthermore, the sealed electric compressor is capable of supplying electric power input from a power source to the motor via an inverter and variably controlling the rotation speed of the compressor in accordance with the air-conditioning load.

In a proposed example of an electric compressor driven via an inverter in this manner, a control circuit board and the like that constitute the inverter are accommodated within an inverter box formed integrally with the outer periphery of the housing of the electric compressor so that the inverter is integrated with the electric compressor, and heat-generating electrical components, like power-controlling semiconductors, such as smoothing capacitors, that minimize the ripple of current supplied to the control circuit board and the like, and insulated gate bipolar transistors (IGBTs) are accommodated within the inverter box (for example, see Japanese Unexamined Patent Application, Publication No. 2003-153552 and the Publication of Japanese Patent No. 3786356).

In the integrated-type electric compressor discussed in Japanese Unexamined Patent Application, Publication No. 2003-153552, the heat-generating electrical components, such as IGBTs, mounted on the lower surface of the circuit control board of the inverter, with a gap therebetween, within the inverter box are in abutment with the bottom surface of the inverter box, that is, a heat-dissipating flat section (heat sink) thermally connected to the outer wall of the housing of the electric compressor, via a heat dissipation sheet composed of silicon rubber, as shown in FIG. 1 of the publication, whereby the heat of the electrical components is dissipated toward the housing.

In the integrated-type electric compressor discussed in the Publication of Japanese Patent No. 3786356, the heat-generating electrical components mounted on the lower surface of the circuit control board of the inverter, with a gap therebetween, within the inverter box are disposed directly in abutment with the bottom surface of the inverter box (housing), as shown in FIG. 2 of the publication, whereby the heat of the electrical components is dissipated toward the housing.

In order to maximize the heat dissipation effect for the heat-generating electrical components in such an inverter-integrated electric compressor, it is preferable that the electrical components be fastened to the bottom surface of the inverter box, that is, the heat-dissipating flat section of the housing, by using fastening members, such as screws, or be bonded thereto via an adhesive sheet or the like so that the electrical components and the heat dissipation surface are fixed and thermally connected to each other.

Because such an inverter-integrated electric compressor in general is directly attached to an engine of a vehicle, the inverter-integrated electric compressor constantly receives vibrations from the engine, vibrations from the vehicle body, rotational vibrations from the motor, and the like when the vehicle is running. The vibrations are also applied to the control circuit board of the inverter, causing the control circuit board to resonate mainly in the thickness direction thereof within the inverter box.

Therefore, with the configuration of the inverter-integrated electric compressor discussed in Japanese Unexamined Patent Application, Publication No. 2003-153552 and the Publication of Japanese Patent No. 3786356, relative displacement repeatedly occurs between the electrical components, mounted on the lower surface of the control circuit board with a gap therebetween and fixed to the bottom surface (i.e., the heat-dissipating flat section) of the inverter box by fastening or bonding, and the control circuit board vibrating in the thickness direction thereof. As a result, metal fatigue accumulates in lead terminals (pin terminals) that connect the electrical components to the control circuit board, possibly leading to deformation or breakage of the lead terminals with long-term use.

On the other hand, when assembling the inverter, the multiple electrical components are first arranged on the bottom surface (i.e., the heat-dissipating flat section) of the inverter box with their lead terminals oriented upward and are fastened thereto using screws or the like. Subsequently, the control circuit board is placed thereon from above, and the multiple lead terminals of the electrical components are inserted into lead-terminal through-holes in the control circuit board before the lead terminals are each soldered to the control circuit board. Therefore, an assembly procedure that involves a difficult and complicated positioning process is necessary, and moreover, the soldering process needs to be performed within the inverter box of the electric compressor. For this reason, the main body of the electric compressor needs to be conveyed in the assembly line of the inverter, resulting in extremely poor workability for assembling the inverter and its surrounding area.

BRIEF SUMMARY OF THE INVENTION

In view of these circumstances, an object of the present invention is to provide an inverter-integrated electric compressor that can effectively dissipate the heat of a heat-generating electrical component mounted on a control circuit board of an inverter, prevent a lead terminal that connects this electrical component to the control circuit board from breaking due to vibration, and provide satisfactory workability for assembling the inverter and its surrounding area, as well as providing an assembly method therefor.

In order to solve the aforementioned problems, the present invention employs the following solutions.

Specifically, an inverter-integrated electric compressor according to a first aspect of the present invention includes an inverter box provided on an outer periphery of a housing; an inverter having a control circuit board and accommodated within the inverter box; an electrical component mounted on one surface of the control circuit board and constituting the inverter; and a heat-dissipating flat section provided on an inner wall of the inverter box. The electrical component is disposed in abutment with the heat-dissipating flat section directly or via a heat conducting member so as to dissipate heat of the electrical component toward the housing. A spacer member is interposed between the control circuit board and the electrical component so as to fill a space between the control circuit board and the electrical component. The spacer member is rigid enough that the control circuit board and the electrical component are prevented from being displaced toward and away from each other.

With the first aspect of the present invention, the spacer member fills the space between the control circuit board and the electrical component and prevents these two components from being displaced toward and away from each other so that relative displacement between these two components is eliminated even when they receive vibration, thereby eliminating the possibility of breakage of a lead terminal of the electrical component due to metal fatigue. Moreover, since the electrical component is in abutment with the heat-dissipating flat section, the heat of the electrical component can be effectively dissipated.

Furthermore, in the above-described aspect, it is desirable that the inverter-integrated electric compressor further include a pressing member that presses at least the electrical component, among the control circuit board, the electrical component, and the spacer member, toward the heat-dissipating flat section.

With the above-described configuration, since the electrical component is pressed toward the heat-dissipating flat section by the pressing member, the heat dissipation effect for the electrical component can be enhanced.

Furthermore, in the above-described aspect, it is preferable that the inverter-integrated electric compressor further include a bonding member that bonds the spacer member to at least one of the control circuit board and the electrical component.

Since the spacer member can be fixed to the control circuit board or the electrical component by providing the aforementioned bonding member, not only are the control circuit board and the electrical component prevented from being displaced toward and away from each other, but relative displacement between the two components in the planar direction is also prevented. Therefore, breakage of the lead terminal of the electrical component is prevented more effectively. In addition, since the spacer member can be fixed to the control circuit board and the electrical component without being dependent on fastening members, such as screws, the workability for assembling the inverter and its surrounding area can be improved. It is desirable that both a surface of the control circuit board and a surface of the electrical component be provided with bonding members.

Furthermore, in the above-described aspect, the spacer member may be composed of an elastic material and may be elastically interposed between the control circuit board and the electrical component.

Accordingly, since the spacer member itself acts as a vibration absorbing member, breakage of the electrical component due to vibration can be effectively prevented, and the electrical component can be pressed toward the heat-dissipating flat section by the elastic force of the spacer member without the use of fastening members, such as screws. Therefore, the workability for assembling the inverter and its surrounding area can be improved, and the heat dissipation effect for the electrical component can be enhanced.

In order to solve the aforementioned problems, an assembly method for an inverter-integrated electric compressor according to a second aspect of the present invention is provided, in which a bonding member for bonding the spacer member to at least one of the control circuit board and the electrical component is provided. In this case, the bonding member is composed of a heat-weldable joining material, and the assembly method includes sub-assembling the control circuit board, the electrical component, and the spacer member in advance; forming an inverter-board assembly by applying heat to the control circuit board, the electrical component, and the spacer member so as to heat-weld the joining material; and installing the inverter-board assembly into the inverter box.

With the second aspect of the present invention, the inverter-board assembly can be assembled outside the inverter box, and lead terminals of a plurality of electrical components can be sub-assembled by inserting them into the control circuit board in advance, whereby the workability for assembling the inverter and its surrounding area can be dramatically improved.

Accordingly, with the inverter-integrated electric compressor and the assembly method therefor according to the present invention, the heat of the heat-generating electrical component mounted on the control circuit board of the inverter can be effectively dissipated, the lead terminal that connects this electrical component to the control circuit board can be prevented from breaking due to vibration, and the workability for assembling the inverter and its surrounding area can be improved.

DETAILED DESCRIPTION OF THE INVENTION

Embodiments of an inverter-integrated electric compressor and an assembly method therefor according to the present invention will be described below with reference to the drawings.

First Embodiment

Figure 1:
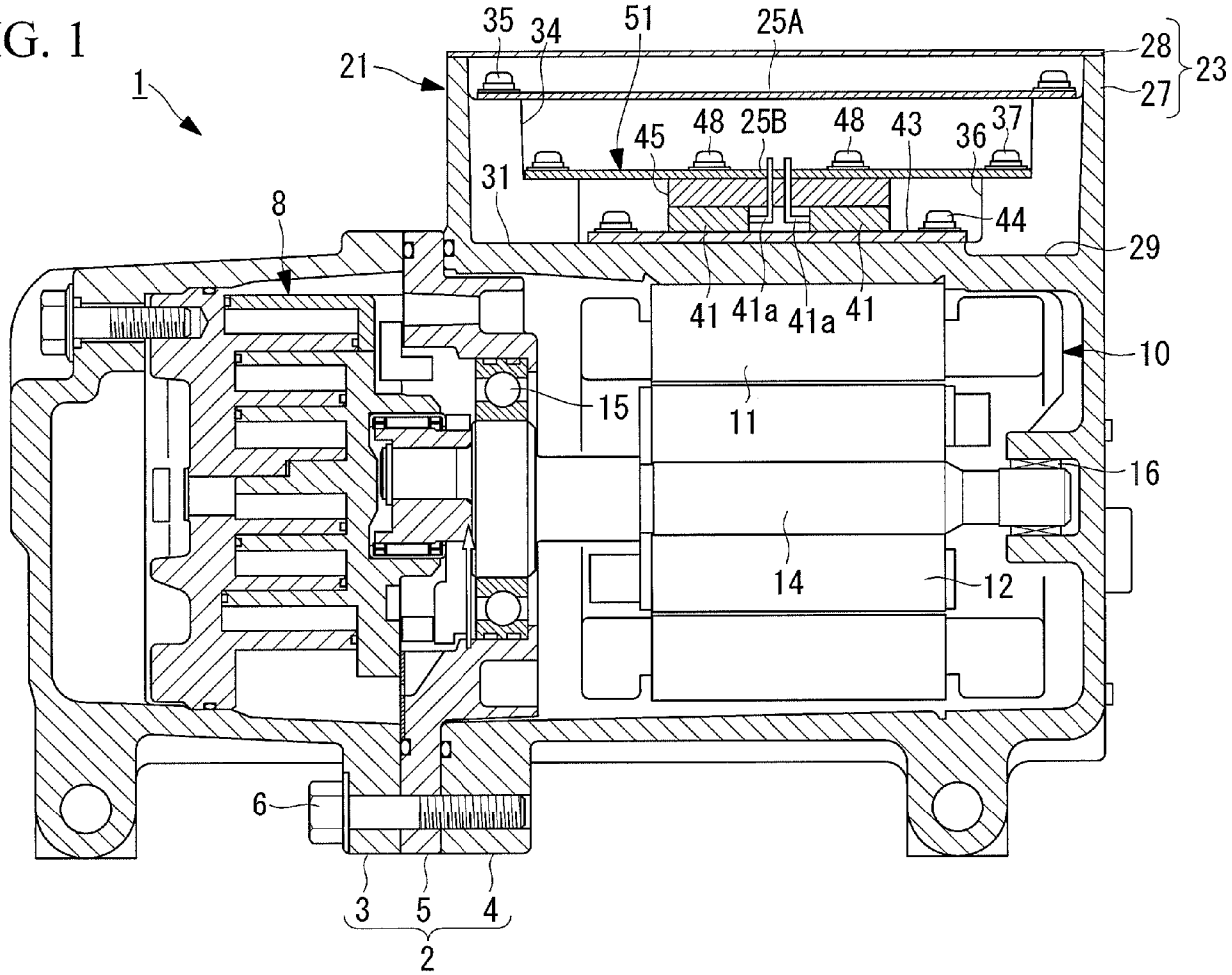
FIG. 1 is a vertical sectional view for explaining the schematic configuration of an inverter-integrated electric compressor according to a first embodiment of the present invention.

A first embodiment of the present invention will be described below with reference to FIGS. 1 to 3. FIG. 1 is a vertical sectional view for explaining the schematic configuration of an inverter-integrated electric compressor according to this embodiment. An inverter-integrated electric compressor 1 is a compressor used in a vehicle air conditioner, and the driving rotation speed thereof is controlled by an inverter.

The inverter-integrated electric compressor 1 has an aluminum-alloy housing 2 serving as an outer shell. The housing 2 is constituted of a compressor housing 3 and a motor housing 4 that are tightly fastened to each other with a bearing housing 5 interposed therebetween by using a bolt 6.

A commonly known scroll compression mechanism 8 is fitted within the compressor housing 3. A stator 11 and a rotor 12 that constitute a motor 10 are fitted within the motor housing 4. The scroll compression mechanism 8 and the motor 10 are linked with each other via a main shaft 14, and the scroll compression mechanism 8 is driven by rotating the motor 10. The main shaft 14 is rotatably supported by a main bearing 15 held by the bearing housing 5 and a sub-bearing 16 held by an end of the motor housing 4.

The end of the motor housing 4 is provided with a refrigerant intake port (not shown), and the refrigerant intake port is connected to an intake pipe of a refrigeration cycle so that low-pressure refrigerant gas is taken into the motor housing 4. This refrigerant gas cools the motor 10 by flowing through the motor housing 4 and is subsequently taken in by the scroll compression mechanism 8 where the refrigerant gas is compressed to become high-temperature high-pressure refrigerant gas. The refrigerant gas is then discharged to a discharge pipe of the refrigeration cycle through a discharge port (not shown) provided at an end of the compressor housing 3.

The motor 10 is driven via an inverter 21, and the rotation speed thereof is variably controlled in accordance with the air-conditioning load. The inverter 21 is integrated with the inverter-integrated electric compressor 1 and is formed by installing, for example, a plurality of control circuit boards, i.e., an upper board 25A and a lower board 25B, one on top of the other within an inverter box 23 formed integrally with the outer periphery of the housing 2 and having a rectangular shape in plan view. The inverter 21 is electrically connected to the motor 10 via an inverter output terminal, a lead wire, a motor terminal, and the like that are not shown in the drawings.

The inverter box 23 has a structure in which, for example, a peripheral wall 27 thereof is formed integrally with an upper portion of the motor housing 4, and an upper opening thereof is closed by a cover member 28 in a liquid-tight manner. The inverter box 23 has a depth that can accommodate the upper board 25A and the lower board 25B constituting the inverter 21, while maintaining a predetermined distance therebetween in the vertical direction. A bottom surface 29 of the inverter box 23 serves as an outer wall of the motor housing 4, and a flat and horizontal heat-dissipating flat section 31 is formed therein. The upper board 25A and the lower board 25B are disposed in parallel with the heat-dissipating flat section 31.

The upper board 25A is fastened to, for example, board-fastening bosses 34, formed in the four corners of the inverter box 23, by using screws 35. The lower board 25B is fastened to board-fastening bosses 36, formed at a position one step lower than that of the board-fastening bosses 34, by using screws 37, and is positioned at about an intermediate height between the upper board 25A and the heat-dissipating flat section 31. For example, the upper board 25A is a CPU board on which a device, such as a CPU (not shown), that operates at low voltage is mounted, whereas the lower board 25B is a power board on which multiple heat-generating devices, such as IGBTs 41, are mounted. In this embodiment, only the upper board 25A and the lower board 25B are shown as the devices that constitute the inverter 21, whereas other devices are not shown in the drawings.

The bottom surface 29 of the inverter box 23 is partly or entirely provided with, for example, a plate-like heat conducting member 43 composed of a highly thermally conductive material, such as an aluminum alloy. Techniques used for fixing the heat conducting member 43 to the bottom surface 29 include fastening using screws 44, using an adhesive, fitting, and casting. The heat conducting member 43 is in abutment with the motor housing 4 composed of an aluminum alloy.

Electrical components, such as the IGBTs 41, are mounted on the lower side of the lower board 25B. Multiple lead terminals (pin terminals) 41*a* of the IGBTs 41 extend through a spacer member 45, to be described later, and are inserted into lead-terminal insertion holes 25*h* (see FIG. 5A), formed in the lower board 25B, from below so as to be connected to the lower board 25B by soldering. The lower surface of each IGBT 41 is in abutment with the heat conducting member 43 so that heat generated by the IGBT 41 is dissipated toward the heat-dissipating flat section 31 via the heat conducting member 43. Alternatively, the heat conducting member 43 may be omitted, and the IGBTs 41 may be disposed in direct abutment with the heat-dissipating flat section 31.

The spacer member 45 is interposed between the lower board 25B and the IGBTs 41. Although the spacer member 45 has a rectangular parallelepiped shape with a rectangular shape in plan view that conforms to the contour shape that collectively surrounds the multiple IGBTs 41, the spacer member 45 may alternatively be, for example, small segments provided individually on the respective IGBTs 41. The lead terminals 41*a* of the IGBTs 41 extend through the spacer member 45 so as to be connected to the lower board 25B.

The upper and lower surfaces of the spacer member 45 are respectively in abutment with the lower surface of the lower board 25B and the upper surface of each IGBT 41 without any gaps therebetween. Specifically, the spacer member 45 fills the space between the lower board 25B and the IGBTs 41.

Various conceivable examples of the material used for forming the spacer member 45 include metal, hard resin, soft resin, an elastic material such as rubber or sponge, and a fibrous material such as paper, cloth, or felt. However, the spacer member 45 must be rigid enough that the lower board 25B and the IGBTs 41 are prevented from being displaced toward and away from each other when the spacer member 45 is attached between the two components 25B and 41. For this reason, if the spacer member 45 is to be composed of an elastic material or a fibrous material, it might be necessary to elastically interpose the spacer member 45 in a compressed state between the two components 25B and 41, depending on the circumstances. This example will be described later in a fourth embodiment and a fifth embodiment.

Furthermore, screws 48 vertically extend through the lower board 25B, the spacer member 45, and the IGBTs 41 so as to fasten these three components 25B, 45, and 41 to the heat conducting member 43 (i.e., the heat-dissipating flat section 31). The screws 48 serve as pressing members that press the IGBTs 41 toward the heat-dissipating flat section 31. As an alternative to the three components 25B, 45, and 41 being collectively fastened to the heat conducting member 43 in this manner, the IGBTs 41 alone may be fastened to the heat conducting member 43 by, for example, forming through-holes, through which the heads of the screws 48 can pass, in the lower board 25B and the spacer member 45. In other words, at least the IGBTs 41 need to be pressed toward the heat conducting member 43.

Figure 3:
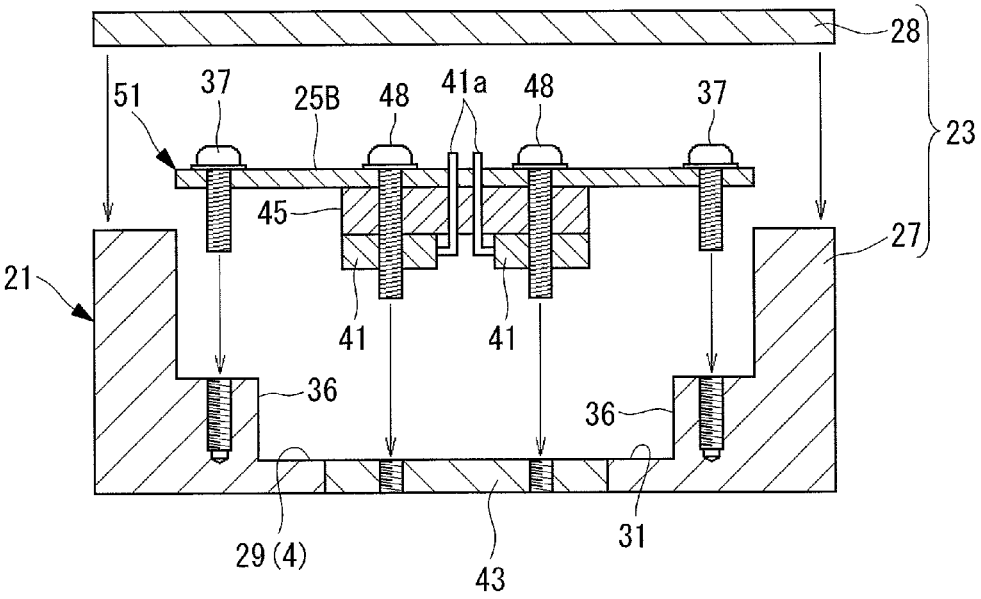
FIG. 3 is an exploded view of the control circuit board and its surrounding area in the first embodiment of the present invention.

When assembling the inverter 21, as shown in FIG. 3, an inverter-board assembly 51 is sub-assembled in advance by stacking the lower board 25B, the spacer member 45, and the IGBTs 41 one on top of the other, inserting the lead terminals 41*a* of the IGBTs 41 into the lower board 25B from below and soldering the lead terminals 41*a* thereto from above, and inserting the screws 37 and 48 into the lower board 25B from above. Then, after setting the inverter-board assembly 51 within the inverter 21 and tightening the screws 37 and 48 so as to fix the inverter-board assembly 51 within the inverter box 23, the upper board 25A is placed and fixed thereon using the screws 35 (see FIG. 1). By subsequently performing a necessary wiring process, the inverter 21 is completed. Finally, the inverter 21 is closed using the cover member 28.

In the inverter-integrated electric compressor 1 having the above-described configuration, low-pressure refrigerant gas circulating in the refrigerant cycle is taken into the motor housing 4 through the refrigerant intake port (not shown) and flows through the motor housing 4 so as to be taken in by the scroll compression mechanism 8. The refrigerant gas compressed to a high-temperature high-pressure state in the scroll compression mechanism 8 travels through the discharge pipe via the discharge port (not shown) provided at the end of the compressor housing 3 so as to circulate in the refrigerant cycle.

During this time, in the inverter box 23, the low-temperature low-pressure refrigerant gas flowing through the motor housing 4 absorbs working heat generated by the IGBTs 41, serving as heat-generating devices of the inverter 21, via the heat-dissipating flat section 31 serving as an outer wall of the motor housing 4 and the heat conducting member 43 having high thermal conductivity. Consequently, the upper board 25A and the lower board 25B constituting the inverter 21 set within the inverter box 23 can be forcedly cooled.

In particular, since the electrical components, such as the IGBTs 41, serving as heat-generating devices mounted on the lower board 25B serving as a power board are disposed such that the lower surfaces thereof are in abutment with the heat conducting member 43, the working heat thereof is directly dissipated toward the heat-dissipating flat section 31 and the motor housing 4 via the heat conducting member 43. Therefore, the lower board 25B serving as a power board, which especially generates a large amount of heat, can be efficiently cooled.

In this embodiment, the spacer member 45 is interposed between the lower board 25B and the IGBTs 41 so that this spacer member 45 fills the space between the lower board 25B and the IGBTs 41. In addition, since the spacer member 45 is rigid enough that the two components 25B and 41 are prevented from being displaced toward and away from each other, relative displacement between the lower board 25B and the IGBTs 41 does not occur even when, for example, the lower board 25B resonates with external vibrations or vibrations from the motor 10.

Therefore, conventional accumulation of metal fatigue of the lead terminals 41*a* caused by relative displacement between the lower board 25B and the IGBTs 41 occurring due to the lower board 25B vibrating alone relative to the IGBTs 41 is avoided, thereby reliably eliminating the possibility of deformation and breakage of the lead terminals 41*a*. Furthermore, since the IGBTs 41 are pressed toward the heat-dissipating flat section 31 by the screws 48, the heat of the IGBTs 41 can be dissipated more efficiently toward the heat-dissipating flat section 31.

The screws 48 extending through the lower board 25B, the spacer member 45, and the IGBTs 41 are fastened to the heat conducting member 43, whereby the IGBTs 41 are pressed against the heat conducting member 43. Therefore, this eliminates the conventional need for an extremely difficult and complicated assembly process involving aligning the IGBTs 41 on the heat conducting member 43 in advance, fixing the IGBTs 41 thereon using screws or the like, placing the lower board 25B in alignment with the lead terminals 41*a*, and performing soldering, whereby the workability for assembling the inverter 21 and its surrounding area can be significantly improved.

When sub-assembling the inverter-board assembly 51, since the assembly work can be performed outside the inverter 21, the main body of the electric compressor does not need to be conveyed in the assembly line of the inverter, whereby the workability for assembling the inverter 21 and its surrounding area can also be improved in this respect. The screws 48 serving as pressing members that press the IGBTs 41 toward the heat-dissipating flat section 31 can conceivably be replaced with other bias members, such as springs and clips.

Second Embodiment

Next, a second embodiment of the present invention will be described with reference to FIG. 4 and FIGS. 5A to 5C.

Figure 2:
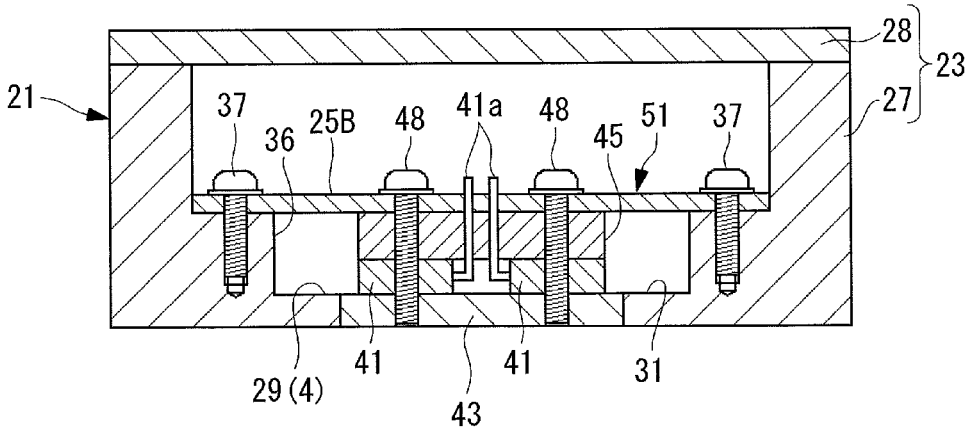
FIG. 2 is a vertical sectional view of a control circuit board and its surrounding area, illustrating the first embodiment of the present invention.

In FIG. 4 and FIGS. 5A to 5C, components that are the same as those in the first embodiment shown in FIGS. 1 to 3 are given the same reference numerals, and descriptions thereof will be omitted.

In the second embodiment, bonding layers 62 are formed on both upper and lower surfaces of a spacer member 61. The bonding layers 62 function as bonding members for bonding the spacer member 61 to the lower board 25B and the IGBTs 41, and can conceivably be composed of an adhesive material, such as an adhesive or double-sided tape, or a heat-weldable joining material, such as solder layers or adhesive resin layers. Although only one bonding layer 62 may be provided on one of the upper and lower surfaces of the spacer member 61, it is preferable that both the upper and lower surfaces be provided with bonding layers 62.

Unlike the first embodiment, the IGBTs 41 are simply bonded to the lower surface of the spacer member 61 via the bonding layer 62 without being screwed onto the heat conducting member 43. Furthermore, because the spacer member 61 is also bonded to the lower board 25B by the bonding layer 62, positional displacement of the IGBTs 41 and the spacer member 61 relative to the lower board 25B does not occur. The lower surfaces of the IGBTs 41 abut on the heat conducting member 43 so that the heat of the IGBTs 41 is dissipated toward the heat conducting member 43.

Since both the upper and lower surfaces of the spacer member 61 are bonded to the lower board 25B and the IGBTs 41 via the bonding layers 62, not only are the lower board 25B and the IGBTs 41 prevented from being displaced toward and away from each other, but relative displacement between the two components 25B and 41 in the planar direction is also prevented. Therefore, breakage of the lead terminals 41*a* of the IGBTs 41 is prevented more effectively.

In addition, in view of the fact that the spacer member 61 can be fixed to the lower board 25B and the IGBTs 41 without being dependent on fastening members, such as screws, and that the lower board 25B, the spacer member 61, and the IGBTs 41 can be sub-assembled in advance, the workability for assembling the inverter 21 and its surrounding area can be significantly improved. Moreover, since it is not necessary to form holes for extending screws through the lower board 25B, strength reduction of the lower board 25B can be avoided.

If the spacer member 61 is composed of a material with no vibration absorbability, such as metal or hard resin, the bonding layers 62 may have cushioning properties so as to be given vibration absorbability and to lightly press the IGBTs 41 toward the heat conducting member 43 with the elastic force of the bonding layers 62, thereby preventing the IGBTs 41 from being lifted upward from the heat conducting member 43 and satisfactorily ensuring the heat dissipation effect for the IGBTs 41.

Figure 5A:
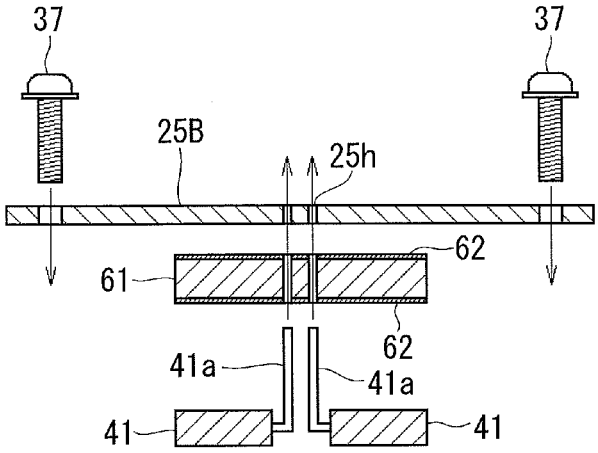
FIG. 5A is a vertical sectional view of an inverter-board assembly being assembled, illustrating an inverter assembly method in the second embodiment of the present invention.
Figure 5B:
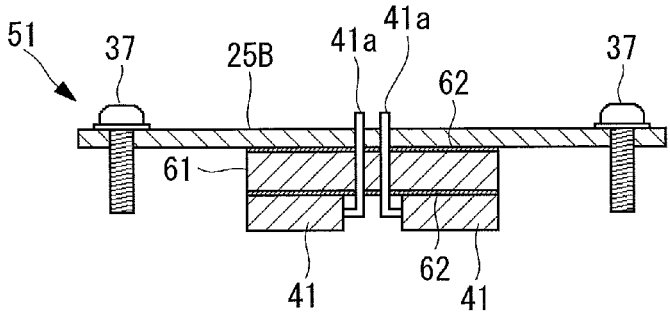
FIG. 5B is a vertical sectional view of the inverter-board assembly in a completed state, illustrating the inverter assembly method in the second embodiment of the present invention.
Figure 5C:
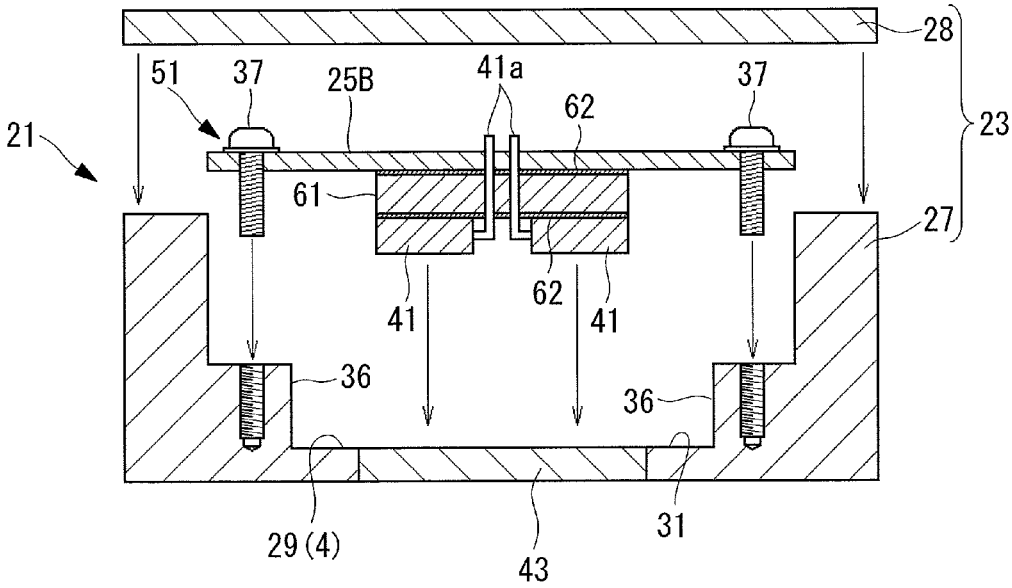
FIG. 5C is a vertical sectional view of an inverter box and the inverter-board assembly, illustrating the inverter assembly method in the second embodiment of the present invention.

FIGS. 5A to 5C illustrate an assembly method of the inverter 21 according to the second embodiment. In this case, the bonding layers 62 are composed of a heat-weldable material, such as solder layers or adhesive resin layers. First, as shown in FIG. 5A, a sub-assembly process is performed in advance by stacking the lower board 25B, the spacer member 61, and the IGBTs 41 one on top of the other. Next, as shown in FIG. 5B, heat is applied to these three components 25B, 61, and 41 so as to heat-weld the bonding layers 62 thereto, thereby forming the inverter-board assembly 51. Then, as shown in FIG. 5C, the inverter-board assembly 51 is disposed within the inverter box 23 and is fastened to the board-fastening bosses 36 using the screws 37. Finally, a wiring process is performed so that the inverter 21 is completed, and the inverter 21 is closed using the cover member 28.

With such an assembly method, the inverter-board assembly 51 can be assembled outside the inverter box 23, and the lead terminals 41*a* of the plurality of IGBTs 41 can be sub-assembled in advance by inserting them into the lower board 25B, whereby the workability for assembling the inverter 21 and its surrounding area can be dramatically improved. In particular, if the bonding layers 62 are solder layers, the heating process for the bonding layers 62 and the soldering process between the lower board 25B and the IGBTs 41 can be performed at the same time, thereby reducing the number of assembly steps and enhancing manufacturability.

Third Embodiment

Next, a third embodiment of the present invention will be described with reference to FIG. 6.

Figure 4:
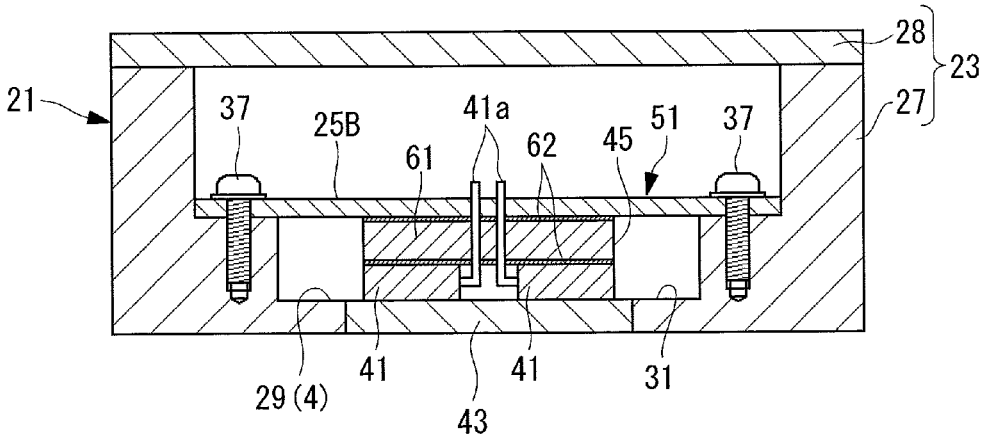
FIG. 4 is a vertical sectional view of a control circuit board and its surrounding area, illustrating a second embodiment of the present invention.
Figure 6:
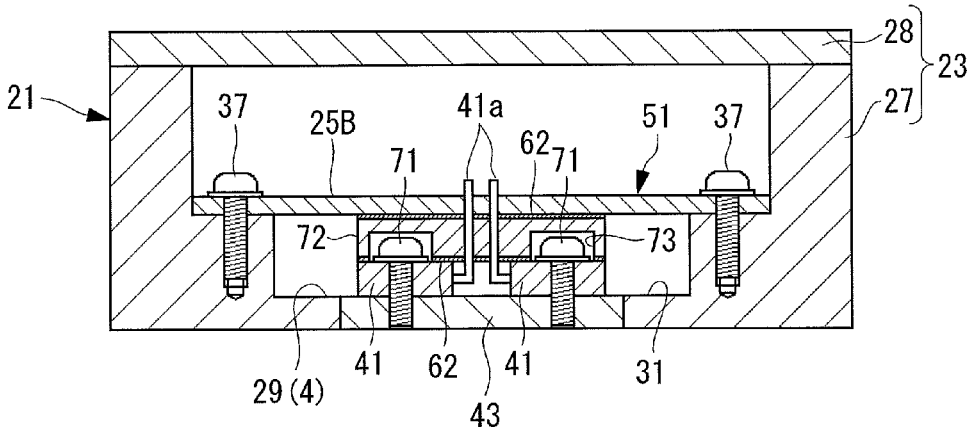
FIG. 6 is a vertical sectional view of a control circuit board and its surrounding area, illustrating a third embodiment of the present invention.

In FIG. 6, components that are the same as those in the second embodiment shown in FIG. 4 are given the same reference numerals, and descriptions thereof will be omitted.

In the third embodiment, the IGBTs 41 are fastened to the heat conducting member 43 using screws 71. Furthermore, recesses 73 for accommodating the heads of the screws 71 are formed in the lower surface of a spacer member 72. Bonding layers 62 similar to those in the second embodiment are used for bonding and positioning between the IGBTs 41 and the spacer member 72 and between the spacer member 72 and the lower board 25B.

With this configuration, the IGBTs 41 alone are first fastened to the heat conducting member 43 using the screws 71, thereby ensuring reliable heat dissipation. The recesses 73 in the lower surface of the spacer member 72 may alternatively be through-holes extending through the spacer member 72, the bonding layers 62, and the lower board 25B.

Fourth Embodiment

Next, a fourth embodiment of the present invention will be described with reference to FIG. 7.

Figure 7:
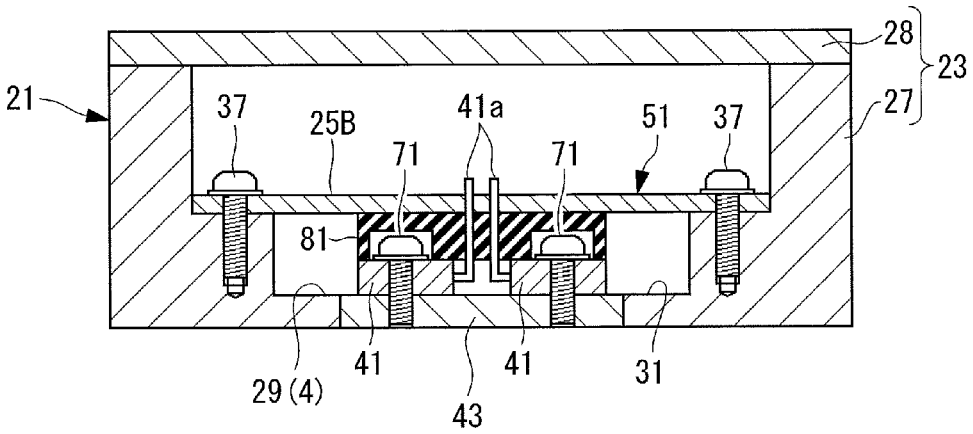
FIG. 7 is a vertical sectional view of a control circuit board and its surrounding area, illustrating a fourth embodiment of the present invention.

In FIG. 7, components that are the same as those in the third embodiment shown in FIG. 6 are given the same reference numerals, and descriptions thereof will be omitted.

In the fourth embodiment, a spacer member 81 is composed of an elastic material, such as rubber, and the spacer member 81 is elastically interposed between the lower board 25B and the IGBTs 41. Specifically, the spacer member 81 is given a slightly large thickness in advance so that when the screws 37 that fasten the lower board 25B to the board-fastening bosses 36 within the inverter box 23 are loosened, the lower board 25B is slightly lifted upward from the board-fastening bosses 36 by the elastic force of the spacer member 81.

Accordingly, since the spacer member 81 itself acts as a vibration absorbing member, resonance of the lower board 25B can be effectively suppressed. Although the screws 71 are used to fasten the IGBTs 41 to the heat conducting member 43, even if the screws 71 were to be omitted, the heat dissipation effect for the IGBTs 41 would still be satisfactorily ensured since the IGBTs 41 are pressed toward the heat conducting member 43 by the elastic force of the spacer member 81, and the workability for assembling the inverter 21 and its surrounding area can also be improved.

Fifth Embodiment

Next, a fifth embodiment of the present invention will be described with reference to FIG. 8.

Figure 8:
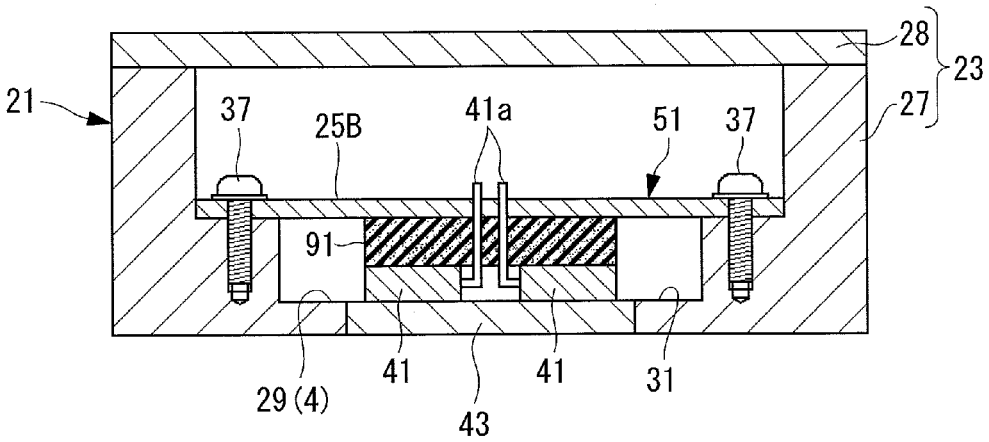
FIG. 8 is a vertical sectional view of a control circuit board and its surrounding area, illustrating a fifth embodiment of the present invention.

In FIG. 8, components that are the same as those in the fourth embodiment shown in FIG. 7 are given the same reference numerals, and descriptions thereof will be omitted.

In the fifth embodiment, a spacer member 91 is composed of a porous or foamed elastic material, such as sponge or urethane foam, and this spacer member 91 is elastically interposed between the lower board 25B and the IGBTs 41.

Although the IGBTs 41 are not fastened to the heat conducting member 43 with screws or the like, since the IGBTs 41 are pressed toward the heat conducting member 43 by the elastic force of the spacer member 91 elastically interposed between the lower board 25B and the IGBTs 41, the heat dissipation effect for the IGBTs 41 is satisfactorily ensured.

Furthermore, because the spacer member 91 is composed of a porous or foamed elastic material, the strength of the elastic force of the spacer member 91 sandwiched between the lower board 25B and the IGBTs 41 can be readily set.

It should be noted that the present invention is not to be limited to the first to fifth embodiments described above. For example, modifications, such as appropriately combining the configurations of the first to fifth embodiments, are permissible so long as they do not depart of the scope of the claims.

What is claimed is:

1. An inverter-integrated electric compressor comprising:

an inverter box provided on an outer periphery of a housing;

an inverter having a control circuit board and accommodated within the inverter box;

an electrical component mounted on one surface of the control circuit board and constituting the inverter, the electrical component including lead terminals for connecting the electrical component to the control circuit board;

a heat-dissipating flat section provided on an inner wall of the inverter box, wherein the electrical component is disposed in abutment with the heat-dissipating flat section directly or via a heat conducting member so as to dissipate heat of the electrical component toward the housing; and a spacer member, wherein the spacer member is in abutment with the control circuit board and the electrical component, and is only interposed between the control circuit board and the electrical component so as to fill a space between the control circuit board and the electrical component, the control circuit board, the spacer member, and the electrical component are fastened together by a fastening member, the fastening member extends through the control circuit board, the spacer member, and the electrical component, the lead terminals extending from a side of the electrical component that is perpendicular to a plane of the circuit board through the spacer members so as to be connected to the control circuit board.

2. The inverter-integrated electric compressor according to claim 1, further comprising a pressing member that presses at least the electrical component, among the control circuit board, the electrical component, and the spacer member, toward the heat-dissipating flat section.

3. The inverter-integrated electric compressor according to claim 1, further comprising a bonding member that bonds the spacer member to at least one of the control circuit board and the electrical component.

4. The inverter-integrated electric compressor according to claim 1, wherein the spacer member is composed of an elastic material and is elastically interposed between the control circuit board and the electrical component.

5. An assembly method for the inverter-integrated electric compressor according to claim 3, wherein the bonding member is composed of a heat-weldable joining material, the assembly method comprising:

sub-assembling the control circuit board, the electrical component, and the spacer member in advance;

forming an inverter-board assembly by applying heat to the control circuit board, the electrical component, and the spacer member so as to heat-weld the joining material; and installing the inverter-board assembly into the inverter box.

6. The inverter-integrated electric compressor according to claim 1, wherein the fastening member is a screw.

* * * * *